United States Patent [19]

Jeffries

[11] Patent Number: 4,767,167

[45] Date of Patent: Aug. 30, 1988

[54] ROTARY STORAGE AND SUSPENSION APPARATUS

[76] Inventor: Alvin B. Jeffries, 3708 Crestview Dr., Newberg, Oreg. 97132

[21] Appl. No.: 104,030

[22] Filed: Oct. 5, 1987

[51] Int. Cl.[4] ..... A47F 5/02

[52] U.S. Cl. ..... 312/268; 211/121; 211/77

[58] Field of Search ..... 211/121, 77, 76, 126; 312/134, 268; 248/359 I

[56] References Cited

U.S. PATENT DOCUMENTS

| | | | |
|---|---|---|---|
| D. 6,562 | 4/1873 | Spencer | 211/77 |
| D. 38,817 | 9/1907 | Malchow | 211/77 |
| 100,114 | 2/1870 | Brown | 211/121 X |
| 859,425 | 7/1907 | Batts | 211/121 X |
| 1,797,032 | 3/1931 | Wendel | 211/121 |
| 1,894,166 | 1/1933 | Elliott | 211/121 |
| 2,533,080 | 12/1950 | Alexander | 312/268 X |
| 2,646,891 | 7/1953 | Morgan | 211/131 |
| 2,928,706 | 3/1960 | Abbott et al. | 312/268 X |
| 3,231,096 | 1/1966 | Dulski | 211/11 |
| 3,318,459 | 5/1967 | Schneider | 312/134 X |
| 3,495,797 | 2/1970 | Ganz | 248/359 I |
| 4,191,435 | 3/1980 | Lehman | 312/266 |
| 4,303,283 | 12/1981 | Muller | 312/135 |

*Primary Examiner*—Joseph Falk

*Attorney, Agent, or Firm*—Henderson & Sturm

[57] ABSTRACT

A rotary storage and suspension apparatus (10) comprising a cabinet unit (11) containing a rotary unit (13) provided with support means (14) for releasably engaging and suspending a plurality of container units (15).

5 Claims, 1 Drawing Sheet

FIG. 1.
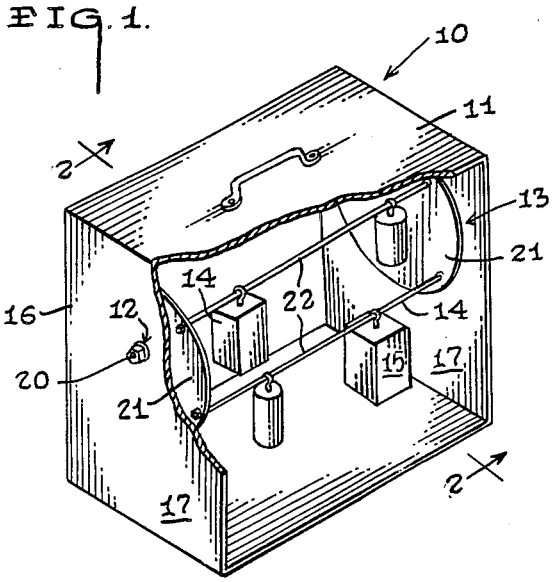
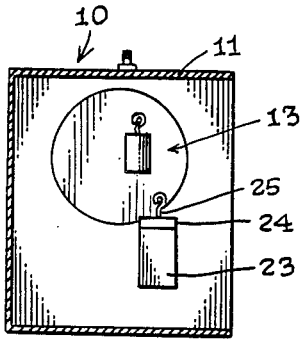
FIG. 2.
FIG. 3.
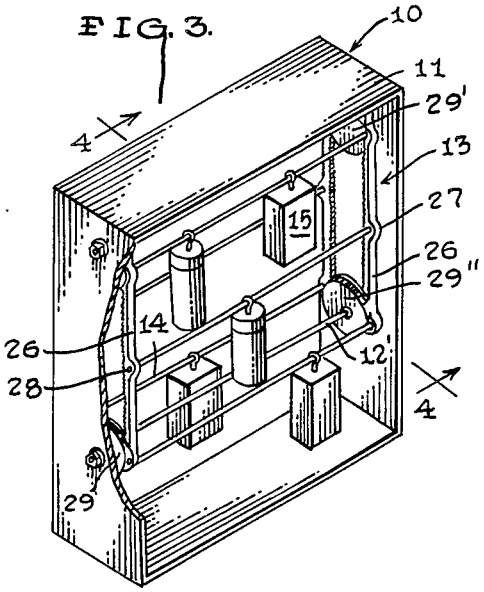
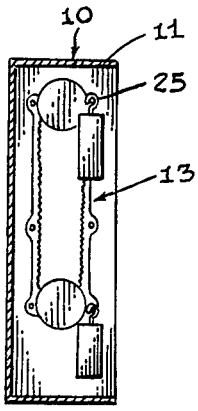
FIG. 4.

ROTARY STORAGE AND SUSPENSION APPARATUS

TECHNICAL FIELD

The present invention relates generally to small item storage devices and more specifically to small item storage cabinets which employ rotatable storage means.

BACKGROUND OF THE INVENTION

As can be seen by reference to the following U.S. Pat. Nos. 4,191,435; 3,231,096; 2,646,891; and 4,303,283, the prior art is replete with myriad and diverse storage systems which employ circular or elliptical transport of a plurality of storage racks about one or more axis to increase efficiency of a storage device.

While all of the aforementioned prior art constructions are more than adequate from the standpoint of fulfilling the basic function for which they were designed, these earlier constructions fall far short of providing an ideal storage arrangement wherein both flexibility and convenience are incorporated into the basic design of the apparatus.

Almost universally lacking from the design of prior art constructions is a provision for the adequate separation and selective displacement of individual containers for discrete articles within the storage apparatus; wherein, the user may physically disengage the discrete article carrier from the storage cabinet and then selectively replace the article carrier on the interior support means of the cabinet.

As can readily be seen by reference to the above cited patents, the use of elongated permanently installed trays as storage means for items in a rotary storage cabinet is a well recognized expedient in the prior art; however, this method is very inconvenient for storing a variety of small items, not to mention the fact that only limited numbers of the discrete articles can be removed at a given time. In addition in such arrangement, the plurality of integrally formed compartments on each of the plurality of trays creates problems since the forward tray elements and their contents oftentimes will obscure the contents of the trailing trays.

Another problem with the prior art tray constructions is their inherent bulk and weight, which naturally makes the storage cabinet difficult to transport from one location to another.

Clearly what has been lacking is a system of a rotary support means that will accommodate conveniently sized individual storage units into which similar items may be grouped, thereby facilitating the access to the individual containers and simplifying the transportation of the storage cabinet as a whole. The provision of such an apparatus is the basis of the present invention.

BRIEF SUMMARY OF THE INVENTION

The present invention relates generally to a new and unique rotary storage cabinet construction, and more specifically to a rotary storage cabinet apparatus having a novel support means for the selective suspended engagement with and the lateral displacement of a plurality of diverse individual storage containers for small articles.

In addition, while the full potential storage area of this new cabinet apparatus is available to be occupies by a multitude of individual storage containers; as a practical matter, only those storage containers that actually contain items and articles will be deployed within the cabinet apparatus, such that the cabinet apparatus will always be at its lightest practical weight while in use.

Since the individual storage containers will be releasably suspended from the support means, more of the contents of the storage apparatus will be visible and assessable to the user, coupled with the fact that the individual storage containers may be selectively removed from the storage apparatus to facilitate the removal and use of the contents of storage containers.

Furthermore, when the individual storage containers are to be replaced in the cabinet apparatus, the user may either position the storage containers in their previous location relative to the support means; or laterally displace the storage containers relative to their previous location; or even select an entirely different location relative to the support means.

Briefly stated, the rotary storage and suspension apparatus of this invention comprises a cabinet unit at least one axle unit associated with the cabinet unit; a rotary unit associated with the axle unit; support means associated with the rotary unit; and a plurality of container units adapted to releasably engage the support means to permit the selective displacement and disengagement of the container units relative to the support means.

BRIEF DESCRIPTION OF THE DRAWINGS

These and other objects, advantages, and novel features of the invention will become apparent from the detailed description of the best mode for carrying out the preferred embodiment of the invention which follows; particularly when considered in conjunction with the accompanying drawings, wherein:

FIG. 1 is a perspective view of one version of the preferred embodiment of this invention;

FIG. 2 is a cross-sectional view of this version taken thru line 2—2 of FIG. 1;

FIG. 3 is a perspective view of an alternate version of the preferred embodiment of this invention; and FIG. 4 is a cross-sectional view of this version taken thru line 4—4 of FIG. 3.

BEST MODE FOR CARRYING OUT THE INVENTION

As can be seen by reference to the drawings and in particular to FIG. 1, the rotary storage and suspension apparatus that forms the basis of the present invention is designated generally by the reference numeral (10). The apparatus (10) comprises in general: a cabinet unit (11); at least one axle unit (12); a rotary unit (13); a support means (140; and, a plurality of container units (15). These units will now be described in seriatim fashion.

In the first version of the preferred embodiment illustrated in FIGS. 1 and 2, it can be seen that the cabinet unit (11) comprises in general a cabinet enclosure member (16) having a pair of opposed side walls (17) a cabinet opening (18) and a closure member (19).

The at least one axle unit (12) comprises a pair of axle members (20) which are aligned with one another and disposed in the upper portion of the opposed side walls (17) of the cabinet enclosure member (16). The axle members (20) are in turn operatively connected to the rotary unit (13), which in this particular version of the preferred embodiment comprises a pair of enlarged rotary disk members (21).

As can best be appreciated by reference to FIG. 1, the support means (14) comprises a plurality of elongated rod members (22) which are operatively connected on their opposite ends at spaced locations around the periphery of the rotary disk members (21).

The plurality of container units (15) comprise in general container members (23) having cap closures (24) which are provided with upwardly projecting hook elements (25); wherein, the hook elements (25) are dimensioned to releasably engage and suspend the container units (15) from the rod members (22) of the support means (14).

In the alternate version of the preferred embodiment depicted in FIGS. 3 and 4, most of the basic components of the apparatus (10) are the same with the exception of the at least one axle unit (12) and the rotary unit (13) of this version.

As is clearly depicted in FIGS. 3 and 4, the alternate version employs a pair of axle units (12), wherein one of the axle units (12) is deployed in the upper portion of the opposed sides (17) of the cabinet member (16); and the other axle unit (12') is deployed proximate to, but below, the midpoint of the sides (17) of the cabinet member (16).

In addition in this version, the rotary unit (13) comprises a pair of pulley members (29) associated with each one of the pair of axle units (12)(12'); and, an elongated closed loop conveyor belt member (26) operatively connected between the upper (29') and lower (29'') pulley members on either side of the cabinet member (16); wherein each of the conveyor belt members (26) are provided with outwardly projecting spaced extensions (27) having apertures (28) which are dimensioned to engage the plurality of elongated rod members (22), which also form the support means (14) of this version.

As can be appreciated by reference to FIGS. 1 thru 4, in both versions of this invention the basic apparatus configuration has been duplicated to provide either a circular or elliptical rotary displacement of the support means (14) relative to the interior of the cabinet unit (11). In addition, the lower arc of the revolution of each of the rotary units (13) is spaced a sufficient distance from the bottom of the cabinet member (16) to allow unimpeded passage of the lower end of the plurality of container members (23); while the upper arc of revolution of the rotary units (130 only has to be spaced from the top of the cabinet member (16) a sufficient distance to permit the passage of the top of the hook elements (25) of the container members (23).

As should also be appreciated by reference to FIGS. 1 thru 4, the plurality of container members (23) may be selectively deployed on any one of the plurality of elongated rod members (22) of the support means (14) and laterally displaced along the length of a given rod member (22). Furthermore, while the container members (23) may be provided with a generally cylindrical and/or rectangular configuration as depicted in the drawings, the rectangular configuration is the preferred shape in as much as that configuration will effectively occupy most of the available storage space within the cabinet member (16).

Having thereby described the subject matter of this invention, it should be obvious that many substitutions, modifications and variations thereof are possible in light of the above teachings. It therefore to be understood that the invention as taught and described herein is only to be limited to the extent of the breadth and scope of the appended claims.

I claim:

1. A rotary storage and suspension apparatus in combination with a plurality of container units wherein the combination consists of:

a cabinet unit comprising a cabinet enclosure member having opposed side walls;

at least one axle unit comprising a pair of alaigned axle members disposed on the opposed side walls of said cabinet enclosure member;

a rotary unit operatively associated with said at least one axle unit;

a support means comprising a plurality of rod members operatively connected on their opposed ends at spaced locations around the periphery of said rotary unit; and, a plurality of container units for different discrete items and articles, adapted to be releasably engaged, laterally translatable with respect to, and suspended from said support means; wherein, each of said plurality of container units comprises a hollow container member having a cap closure, wherein the cap closure is further provided with an integral hook element that is dimensioned to engage said support means.

2. The combination of claim 1 wherein said rotary unit comprises:

a pair of enlarged rotary disk members operatively connected to said pair of aligned axle members.

3. The combination of claim 1 wherein the apparatus further comprises a pair of axle units that are disposed on the opposed side walls of said cabinet enclosure member.

4. The combination of claim 3 wherein the rotary unit comprises:

a pair of pulley members associated with each one of said pair of axle units; and, a conveyor belt member operatively connected between the upper and lower pulley members on each of the opposed sides of said cabinet enclosure member.

5. The combination of claim 1 wherein said plurality of container units comprise diverse individual storage container members; wherein some of said storage container members have a generally cylindrical configuration and others of said storage container members have a generally rectangular configuration.

* * * * *